US012435942B2

(12) United States Patent
Riley

(10) Patent No.: US 12,435,942 B2
(45) Date of Patent: Oct. 7, 2025

(54) SUPPRESSOR FOR A FIREARM

(71) Applicant: HiPerformance LLC, New Century, KS (US)

(72) Inventor: Bradford Whittam Riley, Paola, KS (US)

(73) Assignee: HIPERFORMANCE LLC, New Century, KS (US)

( * ) Notice: Subject to any disclaimer, the term of this patent is extended or adjusted under 35 U.S.C. 154(b) by 0 days.

(21) Appl. No.: 18/658,270

(22) Filed: May 8, 2024

(65) Prior Publication Data

US 2024/0384961 A1 Nov. 21, 2024

Related U.S. Application Data

(60) Provisional application No. 63/466,822, filed on May 16, 2023.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32
USPC ..... 89/14.4; 181/223
See application file for complete search history.

(56) References Cited

U.S. PATENT DOCUMENTS

| | | | | |
|---|---|---|---|---|
| 7,905,171 | B1 * | 3/2011 | Brittingham | F41A 21/30 89/14.4 |
| 2011/0036233 | A1 * | 2/2011 | DeGroat | F41A 21/325 89/14.4 |
| 2016/0209151 | A1 * | 7/2016 | Smith | F41A 21/30 |
| 2018/0172383 | A1 * | 6/2018 | James | F41A 21/30 |
| 2020/0232740 | A1 * | 7/2020 | Honigmann | F41A 21/30 |
| 2022/0034620 | A1 * | 2/2022 | Parker | F41A 21/34 |

* cited by examiner

*Primary Examiner* — Bret Hayes
(74) *Attorney, Agent, or Firm* — Bennet K. Langlotz; Langlotz Patent & Trademark Works, LLC

(57) ABSTRACT

A suppressor for a firearm has a body defining an internal volume, a baffle in the body and defining a baffle aperture on a bore axis, a piston element including a mount facility configured for connection to the barrel, the piston element defining a piston bore registered with the bore axis, and the piston element operable to reciprocate with respect to the body along the bore axis between a rest position in which the piston element contacts the baffle and a recoil position in which the piston element is away from the baffle. There may be a spring interfacing the piston element and the body and be operable to bias the piston element to the rest position. There may be a second spring operable to interface the body and the piston element only when the piston element is in a range of positions proximate the recoil position.

10 Claims, 6 Drawing Sheets

SUPPRESSOR FOR A FIREARM

CROSS-REFERENCE TO RELATED APPLICATION

This application claims the benefit of U.S. Provisional Patent Application No. 63/466,822 filed on May 16, 2023, entitled "DECOUPLING SUPPRESSOR MOUNT," which is hereby incorporated by reference in its entirety for all that is taught and disclosed therein.

FIELD OF THE INVENTION

The present invention relates to firearms, and more particularly to a suppressor for a firearm that enables tilting barrel action firearms to cycle normally with the suppressor attached.

BACKGROUND AND SUMMARY OF THE INVENTION

When mounting a suppressor to a tilting barrel action firearm (examples include Glock, Browning, SigSauer, Colt pistols) the weight and leverage of the suppressor hinders the cycling of the action. A decoupler disconnects the suppressor from the firearm, allowing the firearm to cycle normally. Without a decoupler, the pistol will have reduced reliability resulting from failures to properly cycle with a suppressor installed. Decouplers or Nielsen devices have been used for many years. There are many different designs, but all of them rely on a few very similar features.

Existing decouplers typically have a cage, piston, retainer, and spring with the firearm's barrel locating the muzzle end of the piston. The outer diameter of the piston opposite the muzzle has a clearance fit locating on the inner diameter of the cage. The cage is then attached on the opposite side to the blast tube. Then, the opposite end of the blast tube locates the blast baffle that contains the bore for the bullet. Current decouplers rely on small teeth on the piston to engage small features on the back side of the cage to control indexing of the suppressor. During the decoupling process, the piston index is temporarily not located, which provides an opportunity for the piston to reindex to a different location and adversely affect subsequent accuracy of the firearm. The cage and piston are prone to carbon build up and failure. The cage is also difficult and costly to produce.

Furthermore, when an existing decoupler is use with a variety of firearms and cartridges, the decoupling mechanism is prone to bottoming out abruptly. The energy from the suppressor is sharply transferred to the firearm, causing the firearm to further move off target in addition to recoil effects. Also, when the main spring is fully collapsed, the main spring experiences premature wear that eventually leads to failure of the main spring, thereby rendering the suppressor and firearm unusable.

These prior art decoupler devices have many challenges with working reliably because the suppressor baffles must be centered on the bore of the barrel to allow the bullet to pass through without striking the baffles. The prior art decoupler designs are very susceptible to carbon fouling, misalignment, reindexing, and failure to decouple the suppressor from the barrel, rendering the host firearm useless.

Therefore, a need exists for a new and improved suppressor for a firearm that enables tilting barrel action firearms to cycle normally with the suppressor attached. In this regard, the various embodiments of the present invention substantially fulfill at least some of these needs. In this respect, the suppressor for a firearm according to the present invention substantially departs from the conventional concepts and designs of the prior art, and in doing so provides an apparatus primarily developed for the purpose of enabling tilting barrel action firearms to cycle normally with the suppressor attached.

The present invention provides an improved suppressor for a firearm, and overcomes the above-mentioned disadvantages and drawbacks of the prior art. As such, the general purpose of the present invention, which will be described subsequently in greater detail, is to provide an improved suppressor for a firearm that has all the advantages of the prior art mentioned above.

To attain this, the preferred embodiment of the present invention essentially comprises a body defining an internal volume, a baffle in the body and defining a baffle aperture on a bore axis, a piston element including a mount facility configured for connection to the barrel, the piston element defining a piston bore registered with the bore axis, and the piston element operable to reciprocate with respect to the body along the bore axis between a rest position in which the piston element contacts the baffle and a recoil position in which the piston element is away from the baffle. There may be a spring interfacing the piston element and the body and be operable to bias the piston element to the rest position. There may be a second spring operable to interface the body and the piston element only when the piston element is in a range of positions proximate the recoil position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
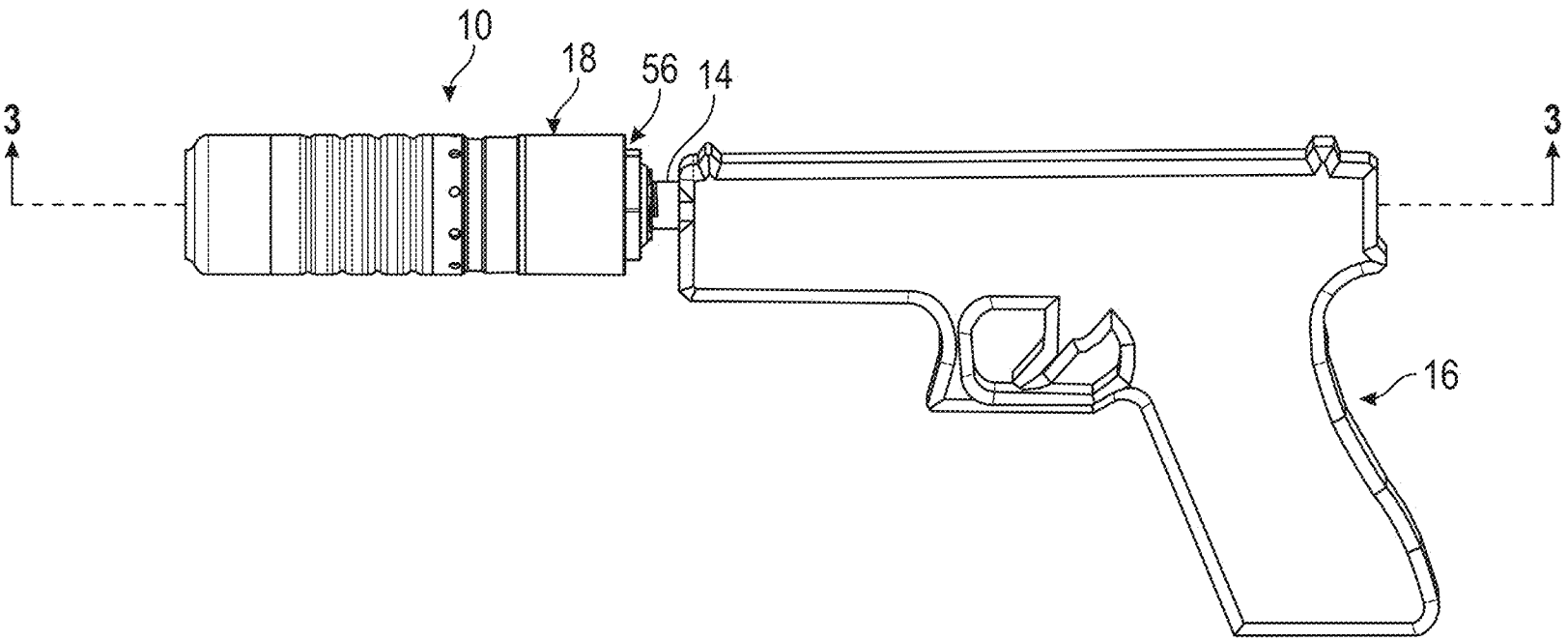
FIG. 1 is a side view of the current embodiment of a suppressor for a firearm constructed in accordance with the principles of the present invention in use attached to the barrel associated with a host firearm.
Figure 2:
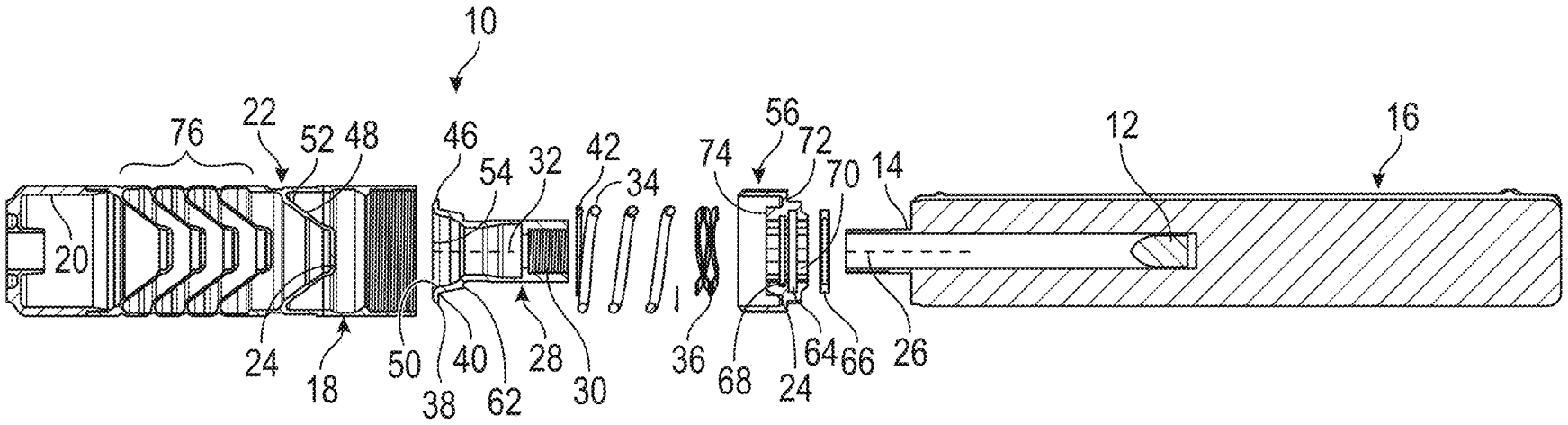
FIG. 2 is an exploded side sectional view of the suppressor for a firearm of FIG. 1.

An embodiment of the suppressor for a firearm of the present invention is shown and generally designated by the reference numeral 10.

Figure 3:
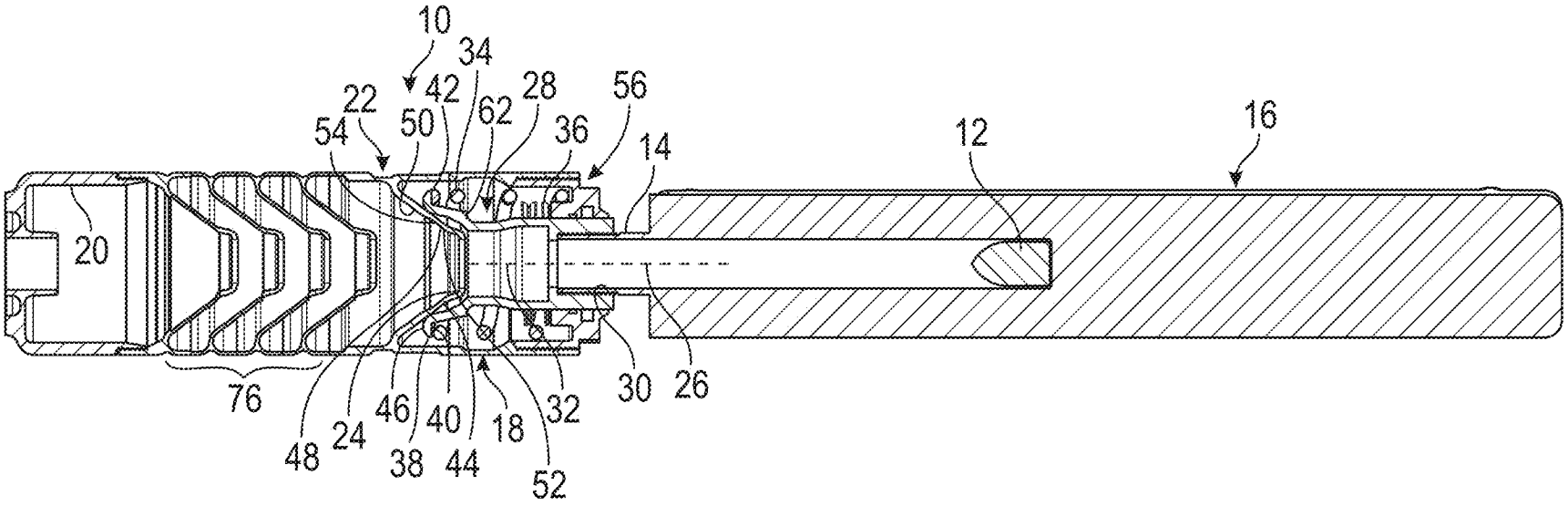
FIG. 3 is a side sectional view of the suppressor for a firearm of FIG. 1 in the rest position.
Figure 4:
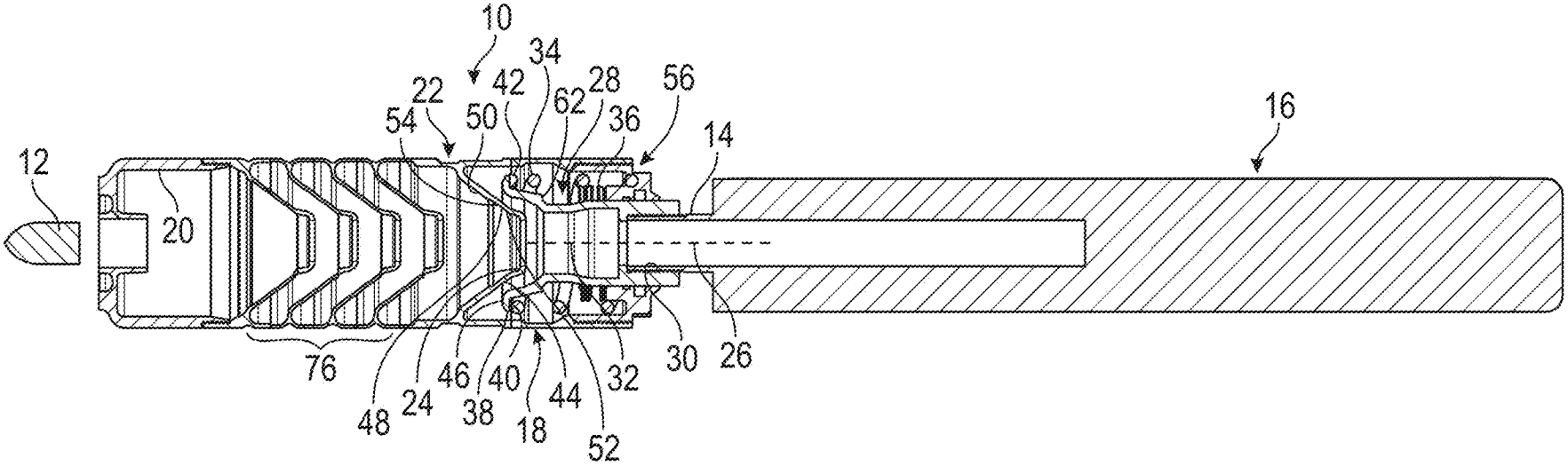
FIG. 4 is a side sectional view of the suppressor for a firearm of FIG. 1 in the recoil position.
Figure 5A:
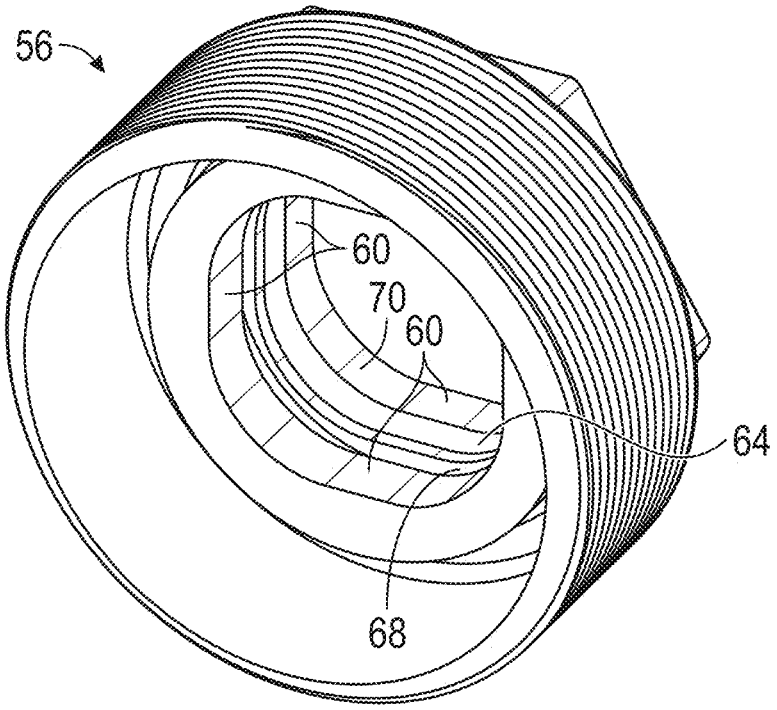
FIG. 5A is an enlarged front isometric view of the retainer of FIG. 1.
Figure 5B:
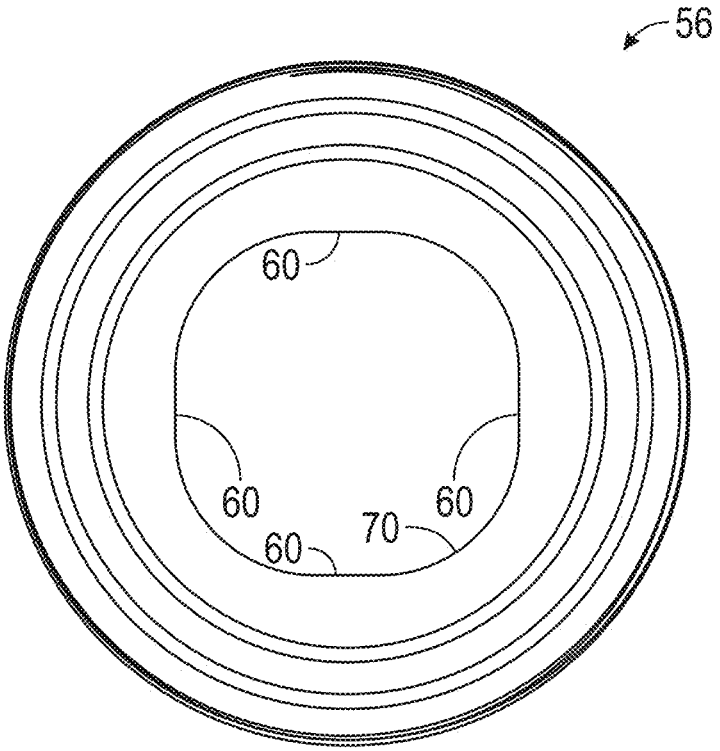
FIG. 5B is an enlarged rear view of the retainer of FIG. 1.
Figure 6A:
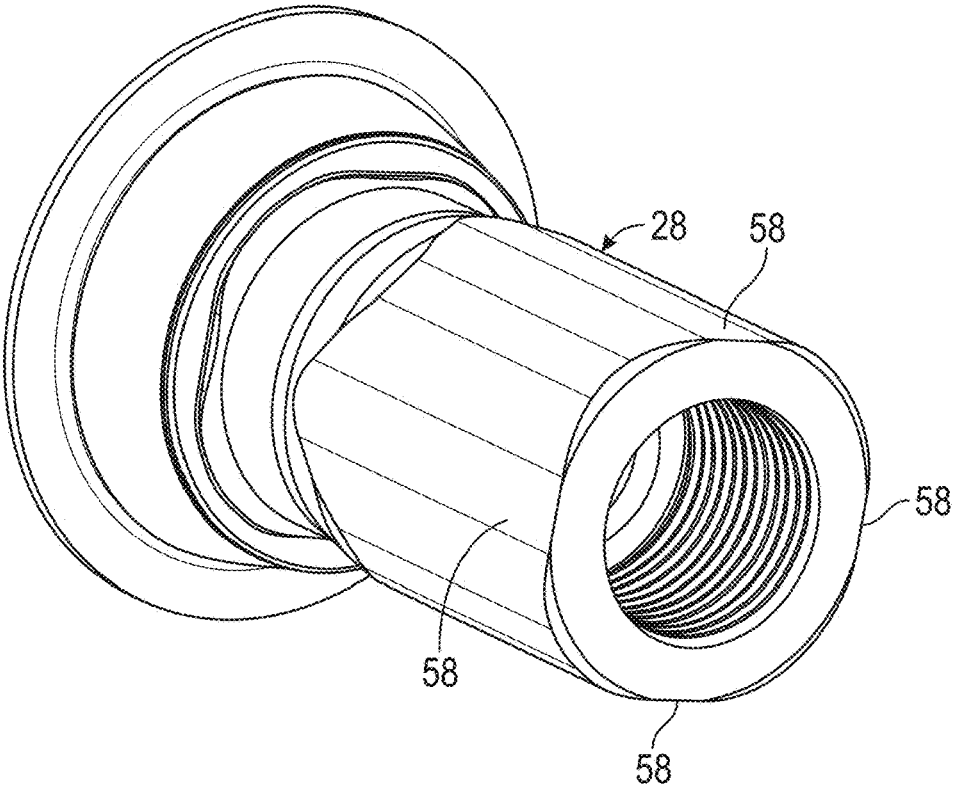
FIG. 6A is an enlarged rear isometric view of the piston element of FIG. 1.
Figure 6B:
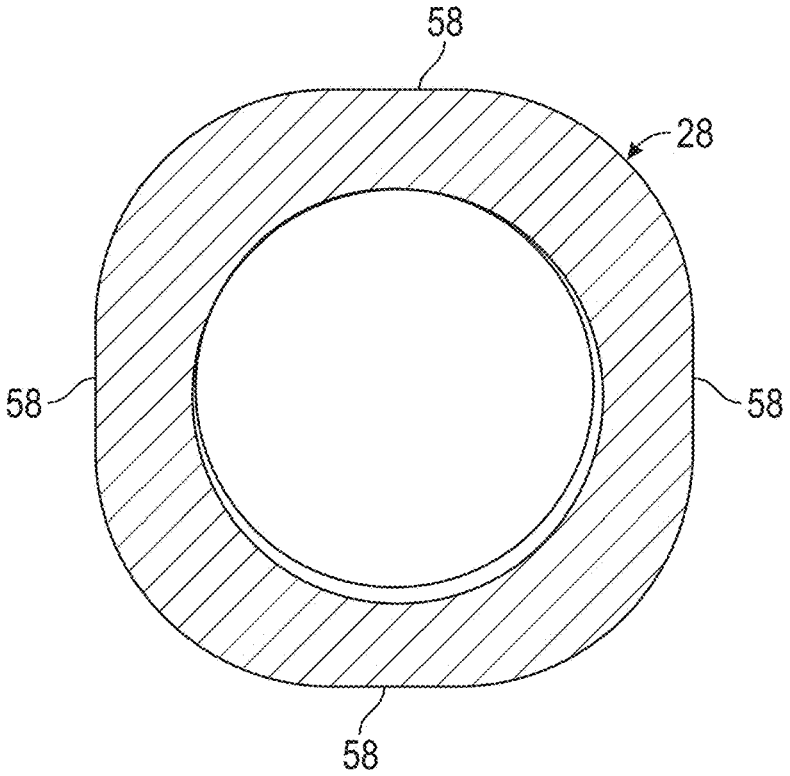
FIG. 6B is an enlarged rear view of the piston element of FIG. 1.

FIGS. 1-4 illustrate the improved suppressor for a firearm 10 of the present invention. More particularly, FIGS. 1, 3 & 4 show the suppressor for a firearm in use attaching the suppressor to the barrel 14 associated with a host firearm 16. A bullet 12 is shown. The suppressor includes a body 18 defining an internal volume 20. A baffle 22 is in the body and defines a baffle aperture 24 on a bore axis 26. The suppressor includes a piston element 28 including a mount facility 30 configured for connection to the barrel. The piston element defines a piston bore 32 registered with the bore axis. The piston element is operable to reciprocate with respect to the body along the bore axis between a rest position (shown in FIGS. 1 & 3) in which the piston element contacts the baffle and a recoil position (shown in FIG. 4) in which the piston element is away from the baffle. Additional baffles 76 can be in the body forward of the baffle 22. In the current embodiment, the body, baffle 22, and baffles 76 form a welded assembly. However, the baffle 22 and baffles 76 can also be inserted into the body or produced as a unitary body by additive manufacturing.

The suppressor for a firearm 10 includes a retainer 56 threadedly connected to the body 18. A spring 34 interfaces the piston element 28 and the retainer and is operable to bias the piston element to the rest position. A second spring 36 is operable to interface the body and the piston element only when the piston element is in a range of positions proximate the recoil position. The second spring serves to reduce premature wear of the spring 34 by preventing the piston element from bottoming out sharply and fully collapsing the spring. An O-ring, coil spring, or other cushioning material can serve the same purpose as the second spring. In the current embodiment, a wave spring is used because the wave spring helps scrape carbon off the outer diameter of the piston element during every cycle to prevent fouling.

The piston element 28 has a forward flange 38 having a rear flange surface 40 contacting a forward portion 42 of the spring 34. The forward portion of the spring is forward of a rear portion 44 of the baffle 22 when the piston element is in the rest position (shown in FIG. 3). The spring 34 and second spring 36 can also be viewed as a dual rate spring assembly operable to resist movement of the piston element from the rest position to an intermediate position between the rest position and the recoil position with a first resistance characteristic (supplied by the spring 34), and to resist movement of the piston element from the intermediate position to the recoil position with a greater second resistance characteristic (supplied by the combination of the spring 34 and second spring 36). The piston element includes a shoulder 62 rearward of the forward flange that contacts the second spring in full recoil.

In the current embodiment, the piston element 28 has flared forward end 46. The baffle 22 has a baffle rear surface contour 48, and the piston element has a forward surface contour 50 configured to mate with the baffle rear surface contour. The baffle also has a conical external surface portion 52, and the piston element has a conical internal forward surface portion 54 configured to contact the baffle conical external surface portion. Using the inner diameter of the piston element to locate on the face of the tapered baffle eliminates the use of the cage required by prior art decouplers. The contact area of the piston element also has a radius that mates to the tapered baffle. This enables the current invention to self-center and self-clean with every cycle. The locating mating surfaces could also be the outer diameter of the piston element and inner diameter of a surface on the baffle to accommodate alternative suppressor designs. Another substantial benefit to having the locating surfaces very close together is a substantial reduction in the alignment path from 5.725 inch associated with a conventional decoupler to 1.505 inch for the current invention.

The piston element 28 includes a square drive feature in the form of flats 58 that engage with flats 60 on the retainer 56. The piston element can be indexed to four different positions, but the piston element is indexed on the outer diameter of the piston element to the inner diameter of the retainer. This area is less prone to carbon fouling, and the carbon that is present is removed by the decoupling action of the device during every shot or cycle. To reindex the piston element, the retainer must be removed, thereby eliminating accidental reindexing during operation. Another benefit is that when torque is applied to the retainer or suppressor, this torque is transferred to the piston element, thereby assisting in mounting or removing the suppressor. The retainer 56 defines an O-ring groove 64 that receives an O-ring 66 and a grease retention groove 68. The retainer also includes a piston guide surface 70, a spring seat 72 for spring 34, and a spring seat 74 for second spring 36.

It should be appreciated that the current invention has numerous benefits compared to prior art decouplers, which include:

- Greatly decreased path of support from the muzzle to the bore of the baffles.
- Increased strength and reliability of supporting the suppressor and maintaining bore alignment.
- Self-cleans the indexing surface. (piston element outer diameter/retainer inner diameter).
- Maintains indexing during the decoupling cycle. (piston element outer diameter/retainer inner diameter)
- Self-cleans the face locating surface. (baffle taper/piston element face)
- Shorter overall.
- Less manufacturing cost.
- Increased durability.
- Greatly increased operation time between necessary maintenance.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a suppressor for a firearm has been described in detail, it should be apparent that modifications and variations thereto are possible, all of which fall within the true spirit and scope of the invention. Although suppressors have been disclosed, the suppressor for a firearm is also suitable for use with other muzzle devices such as blast diverters, flash hiders, muzzle brakes, and compensators. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suppressor for a firearm having a barrel comprising:
a body defining an internal volume;
a baffle in the body and defining a baffle aperture on a bore axis;
a piston element including a mount facility configured for connection to the barrel;
the piston element defining a piston bore registered with the bore axis; and
the piston element operable to reciprocate with respect to the body along the bore axis between a rest position in which the piston element contacts the baffle and a recoil position in which the piston element is away from the baffle.

2. The suppressor for a firearm of claim 1 including a spring interfacing the piston element and the body and operable to bias the piston element to the rest position.

3. The suppressor for a firearm of claim 2 including a second spring operable to interface the body and the piston element only when the piston element is in a range of positions proximate the recoil position.

4. The suppressor for a firearm of claim 2 wherein the piston element has a forward flange having a rear flange surface contacting a forward portion of the spring.

5. The suppressor for a firearm of claim 2 wherein the spring has a forward portion forward of a rear portion of the baffle when the piston element is in the rest position.

6. The suppressor for a firearm of claim 1 including a dual rate spring assembly operable to resist movement of the piston element from the rest position to an intermediate position between the rest position and the recoil position with a first resistance characteristic, and to resist movement of the piston element from the intermediate position to the recoil position with a greater second resistance characteristic.

7. The suppressor for a firearm of claim 1 wherein the piston element has flared forward end.

8. The suppressor for a firearm of claim 1 wherein the baffle has a baffle rear surface contour, and the piston element has a forward surface contour configured to mate with the baffle rear surface contour.

9. The suppressor for a firearm of claim 1 wherein the baffle has a conical external surface portion and the piston element has a conical internal forward surface portion configured to contact the baffle conical external surface portion.

10. The suppressor for a firearm of claim 1 wherein a forward portion of the piston element is forward of a rear position of the baffle when the piston element is in the rest position.

* * * * *